US005100129A

United States Patent [19]

Porter et al.

[11] Patent Number: 5,100,129

[45] Date of Patent: Mar. 31, 1992

[54] LOWER LEG EXERCISE DEVICE

[76] Inventors: E. Illene Porter, 4729 S. 200 West, Ogden, 3; Stephen R. Spencer, 4861 E. 2800 North, Eden, Utah 84310

[21] Appl. No.: 635,854

[22] Filed: Dec. 28, 1990

[51] Int. Cl.[5] ..... A63B 21/04

[52] U.S. Cl. ..... 482/129; 273/55 B; 482/125

[58] Field of Search ..... 272/94, 96, 135, 136, 272/139, 142, 900, 132, 82, 137, 119; 128/75; 36/132, 136

[56] References Cited

U.S. PATENT DOCUMENTS

| | | | |
|---|---|---|---|
| 2,467,943 | 4/1949 | Mikell, Jr. | 272/96 |
| 3,428,312 | 2/1969 | Machen | 272/134 |
| 3,858,874 | 1/1975 | Weider | 272/900 |
| 4,268,037 | 5/1981 | McKinley | 36/136 |
| 4,325,548 | 4/1982 | Piccini | 272/142 |
| 4,340,218 | 7/1982 | Wilkinson | 272/136 |
| 4,371,160 | 2/1983 | Shooltz | 272/96 |
| 4,371,161 | 2/1983 | Williams | 272/96 |
| 4,478,414 | 10/1984 | Molloy | 272/136 |
| 4,565,370 | 1/1986 | Christianson | 272/900 |
| 4,728,103 | 3/1988 | Fulton | 272/142 |
| 4,765,615 | 8/1988 | Case | 272/132 |
| 4,909,505 | 3/1990 | Tee | 272/900 |
| 5,025,802 | 6/1991 | Lako | 128/875 |

OTHER PUBLICATIONS 529810 09019560CAX 272 900

*Primary Examiner*—Richard J. Apley
*Assistant Examiner*—Jerome Donnelly
*Attorney, Agent, or Firm*—A. Ray Osburn

[57] ABSTRACT

A home self-exercising device for strengthening the muscles, tendons and ligaments of the foot, ankle and lower leg, especially the forward lower leg muscles. The foot harness is adjusted to grasp the heel and forward foot of the patient. An elastic tension member is secured to the harness in the vicinity of the ball of the foot, and the other end is secured to an article of furniture or the like. The foot may then be moved against the force of the elastic member in the upward direction and rotated about the ankle. The difficulty of exercising the front lower leg muscles without the aid of another person is overcome by this device.

4 Claims, 2 Drawing Sheets

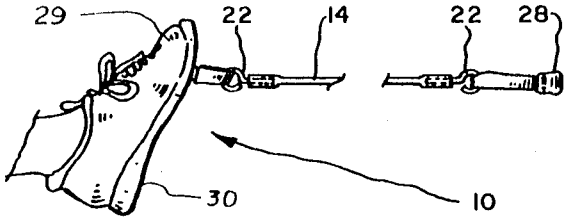
FIG. 5
FIG. 6
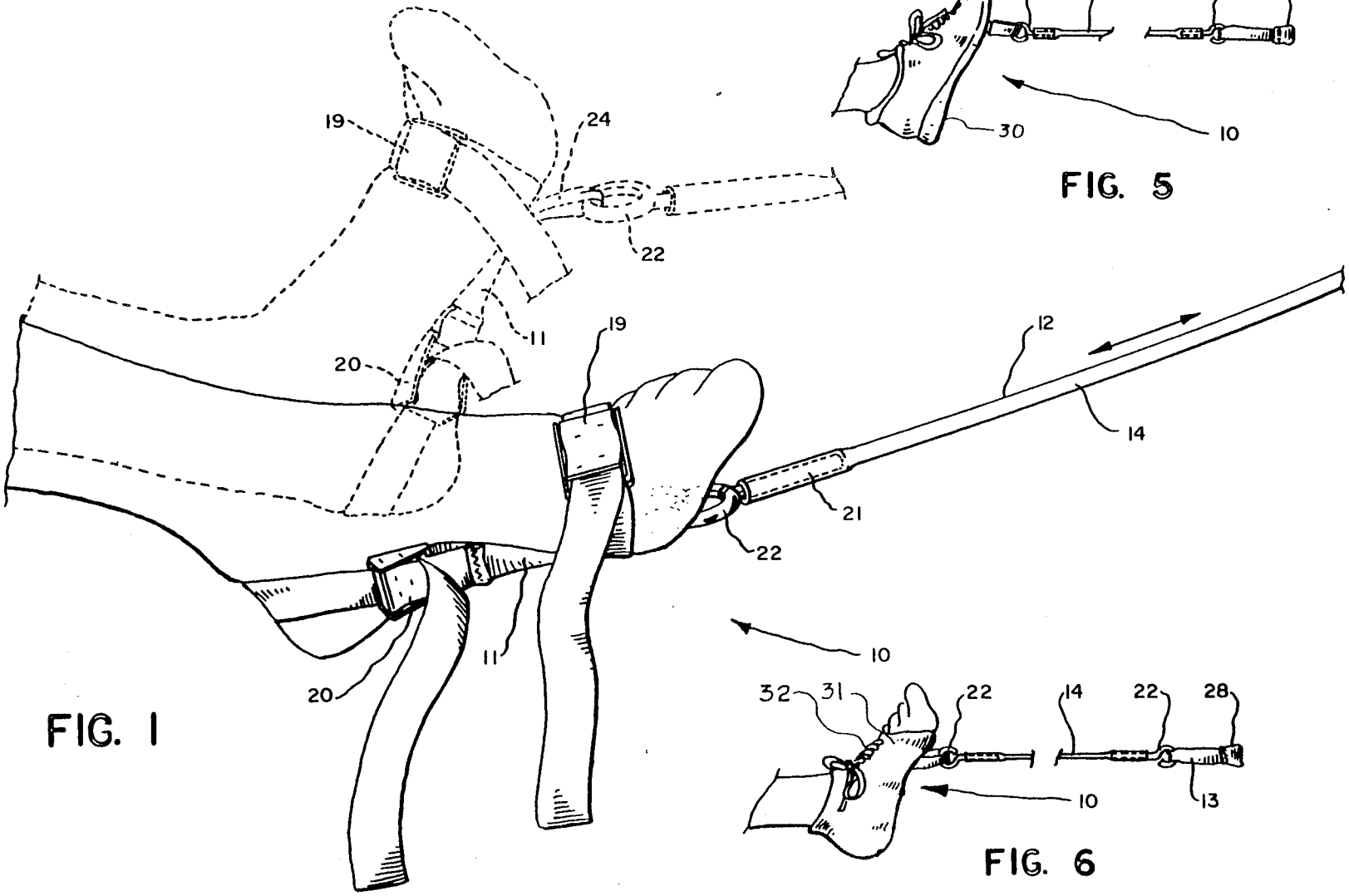
FIG. 1

LOWER LEG EXERCISE DEVICE

BACKGROUND OF THE INVENTION

1.Field

The field of the invention includes devices for strengthening muscles, tendons, and ligaments of the lower leg by exercise, more particularly such devices for unaided home use by the exerciser.

2. State of the Art

Treatment and recovery from accidental or pathological injury to the lower leg and foot often requires selective strengthening exercises of muscles and connective tissues. Many specialized exercise for clinical with this problem have been developed. The physical therapist must, for the lower leg, ankle and foot, provide adequate exercise of both the posterior calf muscles and the forward, anterior, muscles. Clinical machines are available for exercise of both. The large posterior calf muscles are easily exercised away from the clinic by toe tapping, toe standing and the like. However, the exercise of the forward leg muscles, such as the anterior tibialis and the extensor hallicus and the extensor longus, is considerably more difficult to self administer. Generally, these front leg muscles may be exercised only with the aid of a therapist who manually grasps the top of the foot, so that the patient may flex and rotate the ankle against hand resistance. Only in this manner may the front leg and upper foot muscles and associated connective tendons and ligaments be adequately exercised. It is highly desirable that the patient be able to attend to the exercise of these front leg muscles as well as the rear calf muscles without assistance. A need therefore exists for an appropriate exercise device for use by the patient in his home, outside the clinical setting, unaided by another person.

BRIEF SUMMARY OF THE INVENTION

With the foregoing in mind, the present invention substantially alleviates the shortcomings and disadvantages in prior art exercise devices and technique pertaining to lower leg, foot and ankle injuries, by providing a simple economical device which may be employed by the patient outside the clinical setting without the aid of another person. The ankle and lower leg exercise device comprises a harness securable about the foot of the patient, to which is attached an elastic tension member anchored to provide resistance to flexure and rotation of a foot about the ankle. The tension member is preferably secured near the ball of the foot. Its distal end comprises provisions for anchoring to the leg of a massive article of furniture, or to a door jamb or the like. The foot harness preferably comprises a forward loop adjustable to snugly encircle the foot in the ball region distantly from the ankle, to the bottom of which is secured a rearwardly extending loop similarly adjustable about the heel. The tensile member is also fastened to the bottom of the foot loop so that the patient may work against its tension by rotating and flexing his ankle. This type of exercise to the muscles of the forward side of the leg and the upper part of the foot is not achievable otherwise without the aid of another person, differing from exercise of the calf muscles which may be achieved by toe tapping or rising upon the ball of the foot and similar exercises. The present device, of course also exercises the rear calf muscles simultaneously with the forward calf leg muscles.

It is therefore the principal objective of the present invention to provide a simple and economical device permitting home self exercise of the anterior tibialis and associated leg and foot muscles and tendons without the aid of a physical therapist or the like.

BRIEF DESCRIPTION OF THE DRAWINGS

In the drawings, which represent the best mode presently contemplated for carrying out the invention, FIG. 1 illustrates foot, ankle and lower leg exercising device in accordance with the invention with the foot harness thereof secured to the foot of a patient, the motion of the foot during exercise being indicated by dashed lines, drawn to a reduced scale, FIG. 2 a view of an exerciser in accordance with the invention detached from the foot, drawn to approximately the scale of FIG. 1, FIG. 3 a perspective view of a fragment of the exerciser of FIG. 2, attached to a fragment of the leg of an anchoring furniture item, drawn to a reduced scale, FIG. 4 the fragment of FIG. 3, however secured between a door panel and jamb for anchoring, drawn to the approximate scale of FIG. 3, FIG. 5 a reduced scale representation of an alternative embodiment in accordance with the invention, wherein the foot grasping means comprises a conventional shoe, and FIG. 6 a representation of a further alternative embodiment in accordance with the invention, wherein the foot grasping portion thereof comprises a sheath about the foot, drawn to the approximate scale of FIG. 5.

DETAILED DESCRIPTION OF ILLUSTRATED EMBODIMENTS

Figure 2:
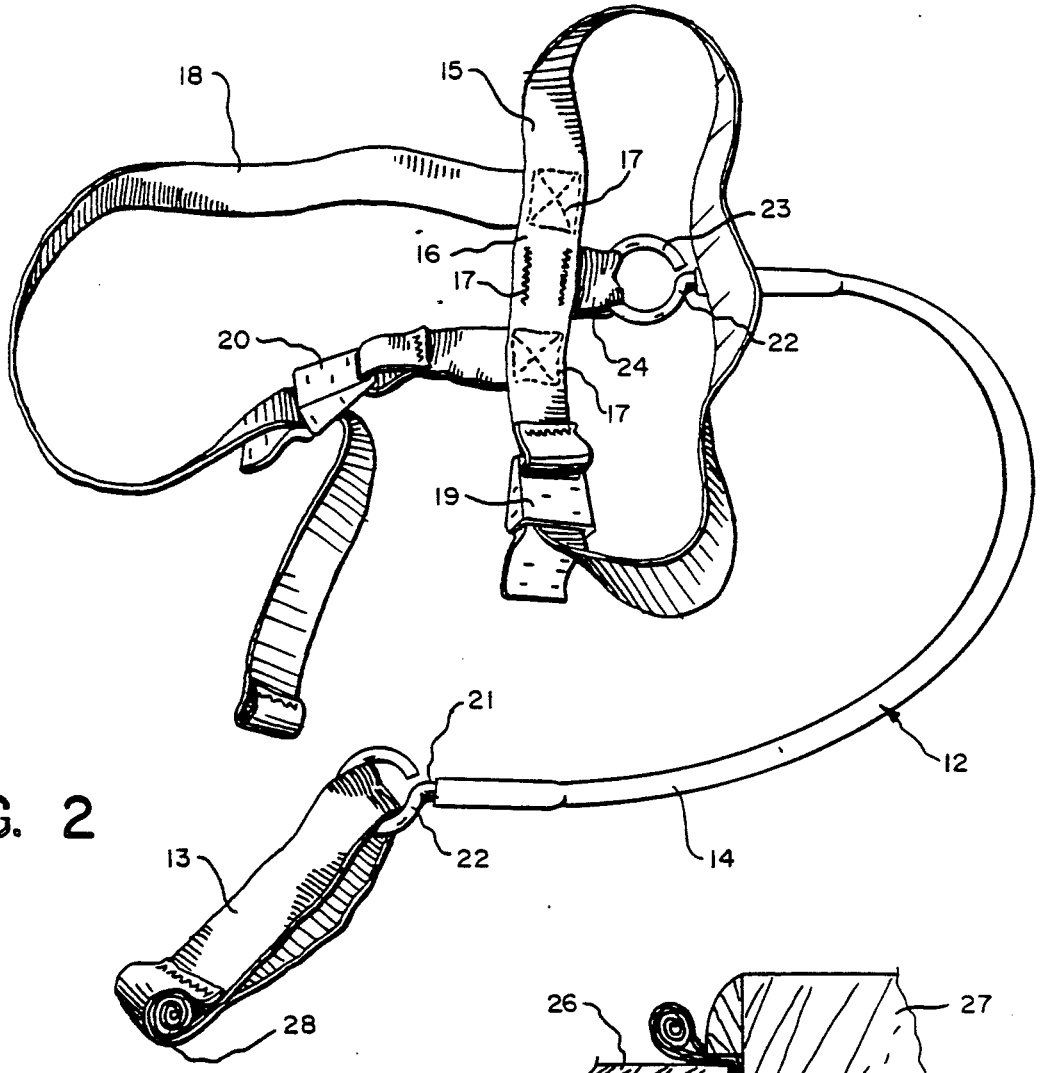

Lower leg and ankle exerciser 10 is seen in FIG. 1 attached to the foot of a user. Exerciser 10, depicted and detached in FIG. 2, comprises a foot-attaching harness 11, to which is secured an elongate tension assembly 12 with an end anchoring loop 13. Tension assembly 12 has an elongate elastic portion 14, providing tension to resist flexure and rotation of the foot about the ankle. See dashed line depiction in FIG. 1. With the exception of tension member 14, exerciser 10 is preferably constructed largely of flexible but non-elastic strapping with little give under tension, so that the foot may be lightly but firmly engaged.

Foot harness 11 has a forward foot loop 15 which encircles the foot well forward of the heel, preferably in the knuckle or ball region. Attached to the bottom 16 of loop 15 as by stitching 17 is a rearwardly extending loop 18 which engages the rear of the heel below the ankle joint and the Achilles tendon.

Strap clamping buckles 19 and 20 enable adjustment of heel and forward foot loops 18 and 15 respectively to secure harness 11 firmly to feet of various sizes. Preferably, heel loop 18 is adjusted to place forward loop 15 immediately behind the knuckle of the large toe, with tension assembly 12 attached in the vicinity of the ball of the foot.

Illustrated tension assembly 12 utilizes a length of standard surgical tubing for the elongate elastic portion 14. A twelve inch length of ½" tubing 14 provides suitable elongation and tension, and may be frictionally attached very securely at each end to unthreaded stems 21 of a pair of ¼" eyebolts 22, with eyelet ends 23. A short eyelet loop 24, stitched to the bottom 16 of forward loop 15, engages an eyelet 23 of one of the eyebolts 22, securing tension assembly 12 to foot harness 11.

Figure 3:
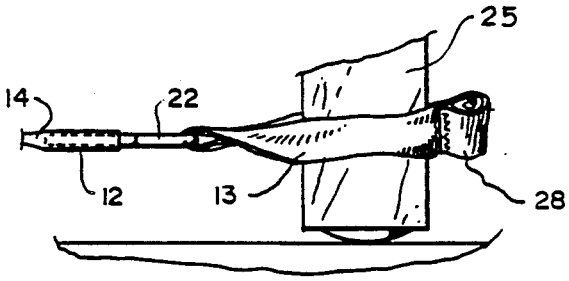
Figure 4:
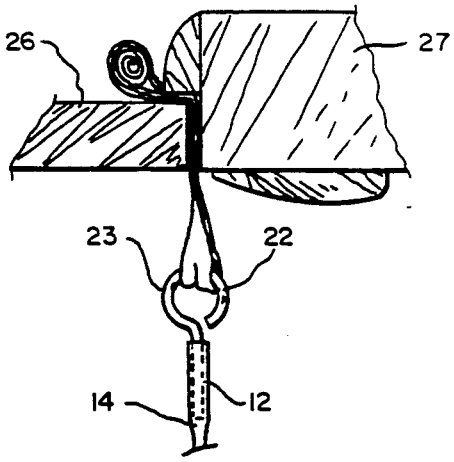

Eyelet 23 of the remaining eyebolt 22 serves to attach anchor loop 13 to elastic tubing 14. Anchor loop 13 may be employed encircling a leg 25 of a sofa, desk or other heavy furniture item. (FIG. 3) Anchoring loop 13 may also be clamped between a door panel 26 and a door jam 27, retained by a rolled fabric knot 28.

To exercise the muscles, ligaments and tendons of the foot, ankle and lower leg, the foot is secured into harness 11 and anchor loop 13 secured as above described. Seated in a chair or the like, or if preferred supine upon a floor mat or the like, the user of exerciser 10 takes a position which places elastic tube into ankle straightening tension against which the muscles must work during subsequent foot and ankle movement. The tension force is directed downward through the ball of the foot, with the knee joint straightened and the leg extended. Without exerciser 10, the patient cannot without the aid of another person stress the foot and ankle in this manner and in this direction. Other forms of auto-exercise, such as toe tapping or rope jumping, urge the ball of the foot upwardly, stressing the posterior calf muscles and the plantar foot muscles, without effectively exercising the anterior lower leg muscles. The anterior tibialis and the associated dorsi muscles of the foot are not effectively stressed by such exercises.

The foot may be rotated and flexed about the ankle, resisted by the yielding tension in tube 14, so that the anterior leg muscles may contract and shorten against continuing force over a considerable distance.

Although illustrated secured to the bare foot, exerciser 10 may if preferred be adjusted for use over a stocking or sock, or even over a shoe, without loss of effectiveness. The illustrated embodiment, comprising distinct foot loop 15 and attached heel loop 18, is preferred as best assuring that resisting force is applied to the top of the foot, simulating the force by an aiding hand. However, other foot attaching arrangements are within the scope and spirit of the invention. For example, the foot attaching harness 11 could be replaced by a conventional shoe 29, with tension assembly 12 fastened to the sole 30 near the ball of the foot. (FIG. 5) Or, if such a shoe is used, tension assembly 12 may be secured only by a foot loop 15, functioning as, and eliminating, heel loop 18. Or, foot sheath 31 with lacing 32 could be devised to replace foot harness 11. (FIG. 6)

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A foot, ankle and lower leg exercising device comprising:

foot grasping means having a forward portion which encircles the foot forwardly of the ankle and the heel, joined with a rearward portion engaging the upright rear portion of the heel generally horizontally;

an elongate tension member, at least a portion of the length of which is substantially elastic, secured at one of its ends to said forward portion laterally central to the bottom of the foot, and extending downwardly therefrom, the other end thereof having provisions to be secured to an immovable object, so that said member may be utilized to place the leg in tension and to elastically resist upward flexure of the foot about the ankle; wherein the elongate elastic portion of the tension member comprises elastic surgical tubing.

2. A foot, ankle and lower leg exercising device comprising:

foot grasping means having a forward portion which encircles the foot forwardly of the ankle and the heel, joined with a rearward portion engaging the upright rear portion of the heel generally horizontally;

an elongate tension member, at least a portion of the length of which is substantially elastic, secured at one of its ends to said forward portion laterally central to the bottom of the foot, and extending downwardly therefrom, the other end thereof having provisions to be secured to an immovable object, so that said member may be utilized to place the leg in tension and to elastically resist upward flexure of the foot about the ankle; wherein the forward portion of the foot grasping means comprises strap means forming a loop circling the foot substantially forwardly of the heel;

the rearmost portion of the foot grasping means comprises strap means secured to the forward foot loop and engaging the rear of the heel therearound so as to secure the forward foot loop against forward motion with respect to the foot, the forward foot loop and the heel loop each being of selective size; and the elongate elastic portion of the tension member comprises elastic surgical tubing.

3. The exercising device of claim 2, wherein the tension member further comprises frictionally engaged eyebolt means telescoped into each end of the surgical tubing;

flexible fabric strap loop means secured to the forward foot loop and engaging the associated eye bolt means; and anchor loop means engaging the eye bolt at the distal end of the tension member.

4. The exercising device of claim 3, wherein:

the anchor loop means comprises flexible strapping joined at its ends to form a wad, so that the strap may be anchored between a conventional door panel and its associated jamb.

* * * * *